United States Patent [19]

Locurto

[11] Patent Number: 4,660,835

[45] Date of Patent: Apr. 28, 1987

[54] TETHERED BALL GOLF PRACTICE DEVICE

[76] Inventor: Anthony F. Locurto, 1143 Doralee Way, San Jose, Calif. 95125

[21] Appl. No.: 792,508

[22] Filed: Oct. 28, 1985

Related U.S. Application Data

[63] Continuation-in-part of Ser. No. 649,990, Sep. 13, 1984, abandoned.

[51] Int. Cl.[4] ..... A63B 69/36

[52] U.S. Cl. ..... 273/200 R; 273/58 C

[58] Field of Search ..... 273/200 R, 28, 26 E, 273/58 C, 220, 29 A, 198, 184 B, 185 C, 185 D

[56] References Cited

U.S. PATENT DOCUMENTS

| | | | |
|---|---|---|---|
| 1,326,976 | 1/1920 | Schnurr | 273/200 R |
| 1,399,293 | 12/1921 | Craig et al. | 273/200 R |
| 1,579,294 | 4/1926 | Fisk | 273/200 R |
| 1,708,796 | 4/1929 | Lawrence | 273/29 A |
| 3,051,491 | 8/1962 | Cabot | 273/200 R |
| 3,297,321 | 1/1967 | Kuhnes et al. | 273/28 X |
| 3,767,198 | 10/1973 | Boyer | 273/26 E |
| 4,147,353 | 4/1979 | Moore | 273/58 C X |
| 4,570,937 | 2/1986 | Yamada | 273/220 |

FOREIGN PATENT DOCUMENTS

| | | | |
|---|---|---|---|
| 25611 | 12/1935 | Australia | 273/200 R |
| 204451 | 7/1959 | Australia | 273/58 C |

*Primary Examiner*—George J. Marlo

*Attorney, Agent, or Firm*—Thomas Schneck

[57] ABSTRACT

A tethered golf ball having a dome-shaped, force spreading member attached to a portion of the surface of the ball. The force spreading member is a sector of a spherical shell of another golf ball in intimate contact with the principal ball. An eye hook connected through the member enables a three section tether cable to be connected thereto. The cable features a short non-elastic section and two elastic sections with swivels joining the sections.

8 Claims, 5 Drawing Figures

TETHERED BALL GOLF PRACTICE DEVICE

DESCRIPTION

Cross Reference to Related Application

This application is a continuation-in-part of prior application Ser. No. 649,990 filed Sept. 13, 1984, now abandoned.

TECHNICAL FIELD

The present invention relates to an apparatus for practicing driving techniques in the game of golf, and in particular to a tethered golf ball device.

BACKGROUND ART

The game of golf, in order to provide maximum satisfaction to the player, requires a well-developed set of driving skills which embody a precisely controlled application of speed and force. Indeed, golfing is one of the most demanding of sports in terms of accuracy and consistency: the lack of either is immediately punished. To play the game successfully, even at a moderate level of competency requires that the necessary skills be developed through repetitious practice of the essential techniques of the swing.

An optimum gold driving swing is accomplished when the ball is driven in a direction substantially along the path which is being followed at the point of impact by the clubhead. However, due to imperfect technique, most golfers find it impossible to strike the ball without some components of movement of the clubhead in a direction which is perpendicular to the desired direction of the line of flight. The effect of these imperfections in technique is to give the ball excessive spin. Clockwise or counterclockwise directions of spin will result respectively in either left-to-right, or right-to-left movement of the ball, in turn causing hooking or slicing of the ball as it flies. A controlled hook or slice is acceptable and, in fact, is the norm for most players. However, uncontrolled hooking or slicing leads to unpredictable paths of flight and therefore to overall inaccuracy and, ultimately, to dissatisfaction with the golfer's game.

Only repetitious practice, always seeking to minimize the amount of uncontrolled hooking or slicing, is effective in remedying the problem. However, due to the fact that conventional, unrestrained balls require large amounts of space in order to practice event the so-called "short game", to say nothing of practicing drives, available practice time and facilities are restricted by the absence of a sufficient number of practice locations at which practice can be practically and successfully carried out.

Many devices for use as practice aids for golf and various other sports in space-restricted areas have been devised. In general, most of these devices have the objective of simulating actual playing conditions, at least as to some of the critical techniques, while limiting the space which is required to accomplish the desired practice. In one class of equipment, the user strikes or throws the object ball into a receiving net which restrains and sometimes returns the object ball to the user. In another class, the object ball is restrained on a restraining mount or tether so that when the ball is struck the ball moves only a small distance and returns to its original position or to a near proximation thereof.

In Austrian Pat. No. 204,451, M. Gerber shows use of a ball tethered to a stake by means of an elastic cord, interrupted by a swivel.

In U.S. Pat. No. 3,297,321, V. D. Kahnes et al. show a baseball training device having a baseball connected by means of a long cord to a short elastic "shock cord" and then to a spring and a stake. The long cord allows the baseball to be pitched to a hitter along the usual distance between a pitcher's mound and home plate.

Other tethered balls are shown in U.S. Pat. Nos. 1,708,796 to J. Lawrence; 3,767,198 to R. Boyer; 4,147,353 to J. Moore.

In summary, the prior art teaches that in certain games, such as baseball, a free flight characteristic may be achieved by attaching a light cord to a ball and then attaching an elastic cord to a stake and to the cord to achieve tethering.

Because of the very small size of a golf ball, slightly larger than 1.5 inches in diameter, these prior art teachings have not been adapted to golf balls. At first glance, one might simply attach a screw hook into a golf ball and a tethering cord to the hook. However, if this is done, the screw hook will work against the ball over a very small area of the ball surface and will soon crack the ball given the very high impacts of powerful golf driving. To date, there has been no satisfactory way of tethering a golf ball.

SUMMARY OF INVENTION

Accordingly, a need exists for, and it is the object of the present invention to provide a rugged and durable tethered golf ball that can be used safely in small practice areas and provide near perfect simulation of hitting a real but tethered, golf ball. By engineering a ball attachment whereby an actual golf ball can be used, the golfer is able to measure the swing technique by observing the trajectory of the ball and thereby yield the opportunity to analyze and improve on the swing, the ultimate purpose of the proposed golf device.

These objectives of the present invention are accomplished by the construction of a unique tether design made to accommodate a specific method of attachment to an actual golf ball whereby neither would be stressed to the point of destruction. The modified golf ball, to be referred to as the dome golf ball, transfers energy from a clubhead to a tethering cable without undue wear on the ball.

A novel, force-spreading dome-shaped wall is disposed over the ball cover with a conformable, ductile washer. The dome-shaped wall is affixed to an actual golf ball by means of both a threaded fastener and an adhesive which fills the voids between cap and ball, thereby sealing the dome wall to the ball. This sealing technique provides safety and durability by insuring that there is no possibility of the dome golf ball becoming detached from the tether cable.

The tether or entire restraining device consists of a cable having a plurality of separate lengths, two of which have varying degrees of elasticity. A first length, which is a nonelastic nylon cord has a multiple purpose: firstly, as the initial attachment connection to the dome golf ball; secondly, for providing manuverability giving a golfer flexibility to spot ball anywhere directly on a practicing surface or on a tee; thirdly, allowing the ball to spin in the normal fashion of an unrestrained golf ball when hit. The nonelastic cord simulates a true free flight ball. A second elastic length, connected to the cord, allows maximum length of free flight before a gradual restraint is applied as its unextended length is reached. A third elastic length, heavier per unit length than the second elastic length, becomes effective as the elastic limit of the second length is reached and provides a buffer against violent shock being transmitted through the tether to the ball and the restraint.

BEST MODE FOR CARRYING OUT THE INVENTION

Figure 1:
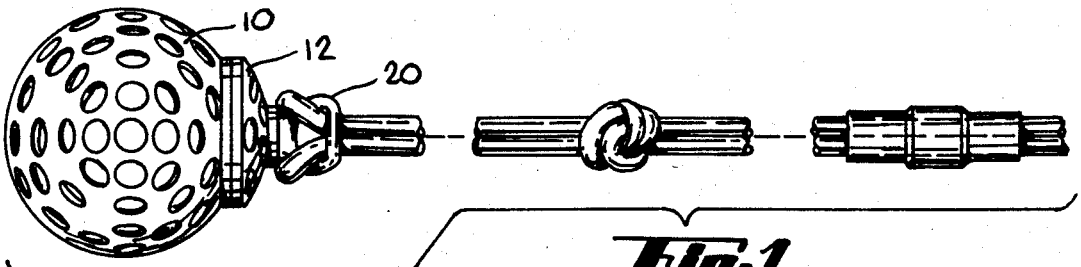
FIG. 1 is a side elevation view of a tethered gold ball in accord with the present invention.
Figure 2:
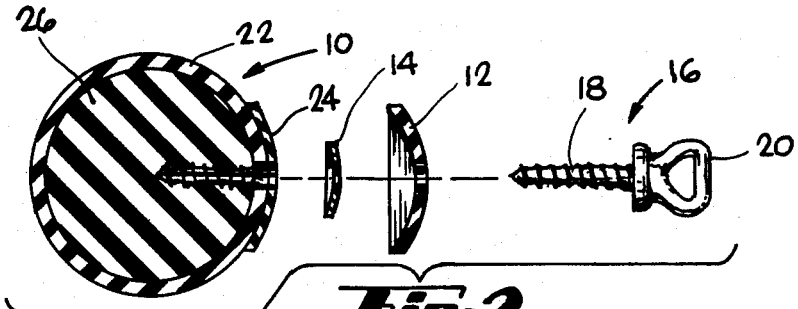
FIG. 2 is a side sectional exploded view of the ball of FIG. 1.

With reference to FIGS. 1 and 2, golf ball 10 is affixed to an attachment device which consists of a dome wall 12, a ductile conforming washer 14, and a threaded fastener 16. The threaded fastener 16 is preferably formed of a shank portion 18 having a very coarse thread for self tapping engagement with the interior of the golf ball and an eye portion 20. A threaded eye could be formed integrally with the dome wall. In this situation, a shank portion would not be needed. Dome wall 12 is preferably made from the same cover material as the ball itself and, most preferably, the dome wall is cut from the exterior cover of a second ball made of material similar to that of the main ball 10. The dome wall covers a circular sector of the main ball having a size greater than 5% of the ball surface, but less than 40% of the surface. A chamfered rim may be provided to help seal the rim of the wall to the main ball.

Washer 14 is preferably of brass or copper or another ductile metal which is suitable for allowing close conformity to the contour of the ball. The ball 10 is seen to have a tough polymer cover 22 and a uniform polymer interior 26, as in balls manufactured by Spalding Company under the Top-Flite trademark. String wound balls are not suitable for use in this invention.

Epoxy resin 24 is applied between the dome wall and the ball cover to fill voids and to provide a durable adhesive fastening of the dome cap to the ball 20 and sealing the interface therebetween. Washer 14 resists pulling out of the threaded fastener 16 from the ball by distributing force against the ball 10 over a larger area of the ball cover. Similarly, the dome wall distributes force between the ball and the fastener by intimate contact with both a significant fraction of the ball cover and the threaded fastener.

The method for constructing the tether attachment involves first roughening the inside of the dome wall and the corresponding area of the exterior of the ball with an abrasive paper, a stiff wire brush, or the like. Next, the cover of the golf ball is drilled or otherwise punctured to provide a pilot hole for the self-tapping threaded fastener 16. Next, the dome wall is also drilled or otherwise punctured to provide a clearance hole for the threaded fastener 16. Then, the threaded fastener 16 is inserted through the dome wall 12 with the brass or copper washer 14 threaded onto the threaded fastener 16. Next, the threaded fastener is partially screwed into the ball 10, but not tightened and the dome wall is pushed snugly against the ball. In the space left by the loosely fastened threaded fastener, epoxy resin is placed between the dome wall 12 and the ball surface. Lastly, the fastener and the dome wall are clamped against the ball and the epoxy resin is allowed to cure.

Figure 3:
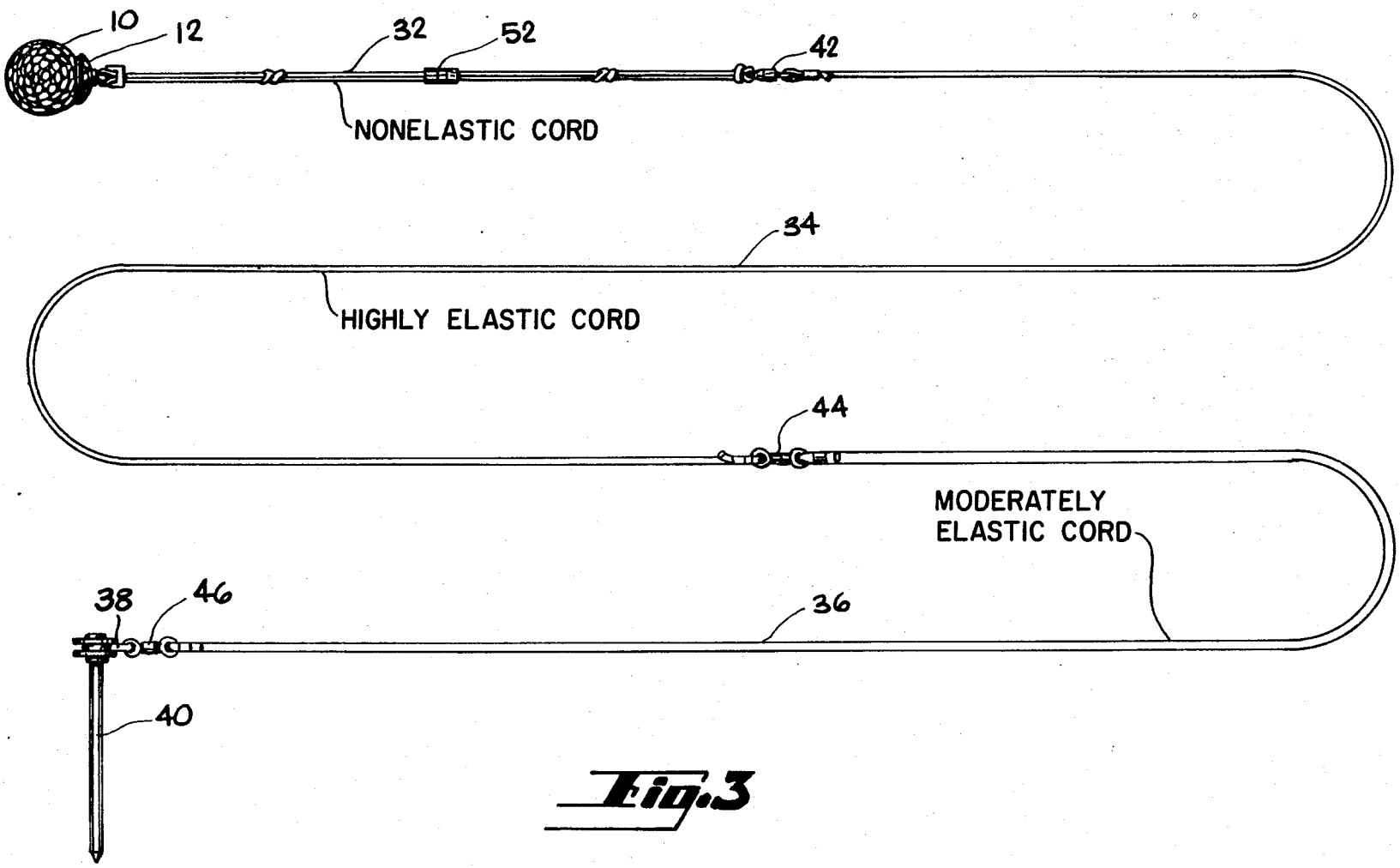
FIG. 3 is a side view of the golf ball of FIG. 1 with a tethering apparatus.

Referring now to FIG. 3, the domed golf ball of the present invention is attached to a cable comprised of three sections 32, 34 and 36. First length 32 is a relatively light weight, strong, relatively nonelastic nylon cord which attaches at one end to ball 10 through dome wall 12 and at the other end to a second length 34 comprising a first highly elastic, shock-absorbing cord. The first elastic, shock-absorbing cord 34 in turn attaches to a second, less elastic cord 36 forming a third length.

The third length has its free end attached by a pivoting mount 38 to a restraining stake 40. Swivels 42, 44 and 46 are used to join the lengths to the stake.

In the preferred embodiment, the first length 32 of relatively nonelastic cord is constructed of a double strand of nylon cord of approximately 4 mm in diameter and is approximately 1.5 feet in length with a splice 52 connecting ends of the strands. Swivels 42, 44 and 46 prevent curling and kinking of the tether due to rotation of the ball. Ball bearing swivels, sold as fishing tackle under the Campco trademark, are preferred. First elastic length 34 is constructed from 4 mm diameter rubber shock cord and is 10 feet in length. Second elastic length 36, having more mass per unit length than the first elastic cord, is constructed from 8 mm diameter rubber shock cord and is 6 feet in length. In manufacturing, lengths 34 and 36 can be altered to accommodate the hitting power of players.

By optimizing the length relationship between the first elastic length 34 and the second shock absorber length 36 the maximum safe restorative effect will also be optimized. It is desirable, for example, that a well hit ball be restrained and returned to the point of departure but not beyond it. An excessive length of nonelastic cord 32 combined with a short length of first elastic cord 34 will result in the ball hitting the ground before it can be accelerated back toward the stake 40, a pivot. On the other hand, a cable length which has too much third length of second elastic cord 36 and too little second length of first elastic cord 34 will result in the ball being returned toward the pivot point with such great force that it will be driven beyond the pivot point and perhaps will have sufficiently great velocity to cause injury should it strike the user.

With the optimally configured tether device, a well hit ball will return very accurately to near the point of departure and the user will be immediately rewarded for his success by a return which minimizes the tedium and time consumption required for retrieval of a poorly hit ball.

Figure 4:
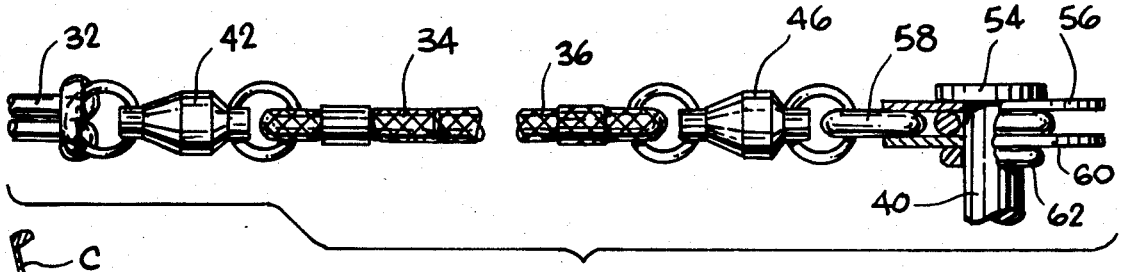
FIG. 4 is a side view of a detail of the tethering apparatus shown in FIG. 3.

In FIG. 4, stake 40 is seen to have a head 54 acting as a stop for a first washer 56. An S-hook 58 is closed and held in position by a second washer 60 and a rubber O-ring 62 disposed against the second washer. An opposite end of the S-hook is closed about an end of swivel 46. The swivels, such as swivels 42 and 46 contain ball bearings for enhanced ball spin. The double stranded nonelastic cord 32 is easy to remove at either end since a slipknot is used in connecting the cord to its swivel 42 at one end and to eye 20 at the opposite end, as seen in FIGS. 1 and 2.

Figure 5:
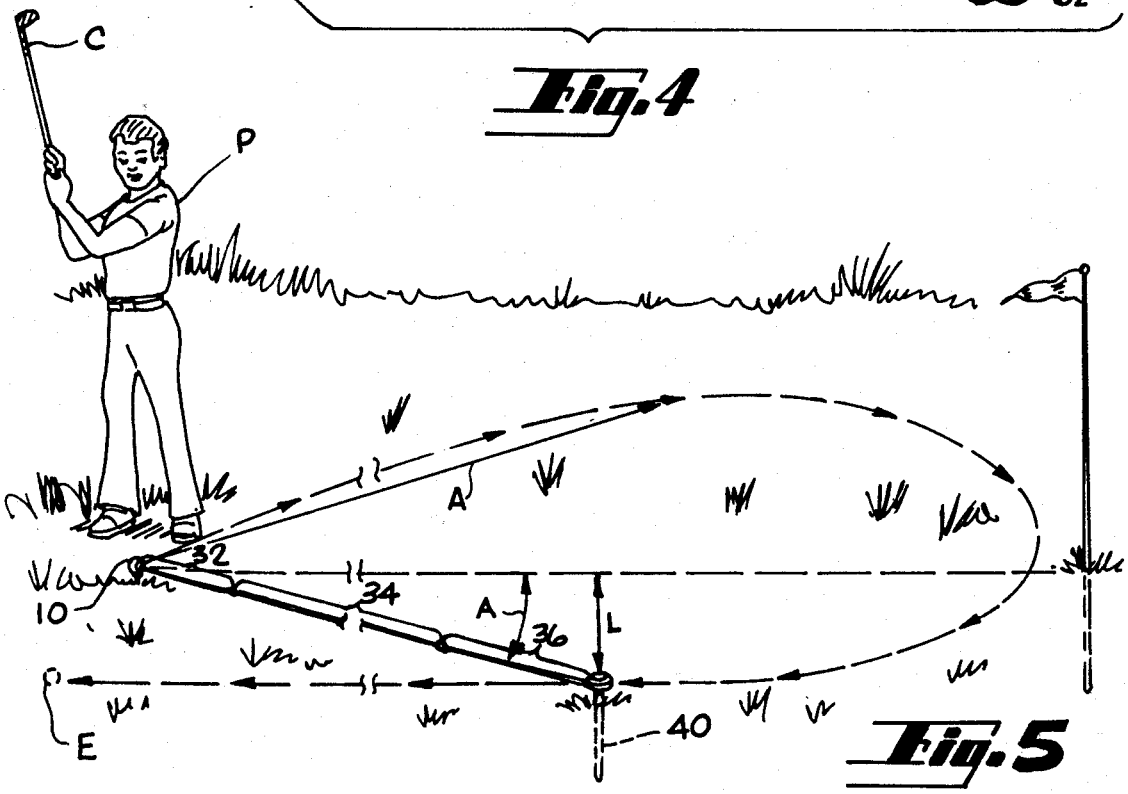
FIG. 5 is a perspective view illustrating use of the apparatus of the present invention.

Use of the present invention is illustrated in FIG. 5 wherein a player, P, addresses ball 10 with club C. The main ball has been placed on a suitable surface or upon a tee, depending upon whether iron shots or wood shots will be practiced. The tether attachment 16 is placed away from the expected point of impact between the club and the ball. Player P swings through the ball using a conventional golf swing just as he or she would do for a conventional nontethered ball. Upon impact, the ball is driven in a direction which is influenced by the impact of the club face, as affected by the relative motion between the ball and the club face, in a direction which is perpendicular to the desired direction of the ball motion. The stake 40 is slightly offset by a distance L, about 3 feet, from this direction so that the ball makes an angle, A, between this direction and the stake 40. This is done to prevent ball rebound to the player.

For the initial several feet of travel the trajectory of the object ball, indicated by arrow A is essentially identical to that of a conventional untethered ball. As the limits of travel of the first and second lengths 32 and 34 are reached, however, the ball begins to be influenced by the restraint imposed by the second and third lengths 34 and 36, and is rapidly decelerated. Ultimately, at the extreme of its flight, these elastic lengths impress a restraining force magnitude which will stop the travel of the ball and, under the restoring force of the second and third elastic lengths 34 and 36 accelerate the ball back toward its original resting position with an accelerating force which is proportional to the initial force with which it was driven away from the original location. The ball moves in an orbit guided by the position of stake 40 to a location E near the player.

The system of the restraining tether previously described has the beneficial effect of allowing great initial free flight to the trajectory of the ball. During the first few yards of travel, there is virtually no difference in the flight of the practice ball and that of a conventional untethered ball. Consequently, the player immediately translates his or her knowledge of the result which occurs given the initial trajectory of untethered ball, into an equivalent set of knowledge as to what would have been the effect on the untethered ball based upon the trajectory of the tethered, practice ball. After a short period of familiarization the user knows at once whether the ball is or is not well hit within the first few yards of flight.

The high impact on the ball due to hard practice shots would ordinarily yank the cable from the ball after a few shots. However, the force-spreading dome-wall of the present invention prevents such an occurrence, distributing the short duration impact of the club head over a significant portion of the surface of the ball, yet preserving flight characteristics of the ball.

I claim:

1. A ball for use in a tethered golf training device comprising, a dimpled golf ball having a tough shell cover, a dome-shaped wall having an interior surface matching the curvature of the exterior surface of said shell cover of said golf ball and in gripping contact with at least 5% of said cover, said wall having an exterior surface having a contour substantially identical to said shell cover and being made of a material substantially identical to that of said cover, said wall having an eye projecting outwardly therefrom, the wall distributing force to said ball from the eye, an epoxy adhesive sealing layer between said wall and said cover, and a tethering cord attached to said eye.

2. A ball for use in a tethered ball golf training device comprising, a first regulation golf ball having a uniform polymer core and a tough, spherical shell cover, said cover surrounding said core, a dome-shaped wall comprising a circular sector of a spherical shell cover of a second golf ball in gripping contact with said spherical shell cover of the first ball and spanning at least 5% of the surface of the cover of said first ball, said shell cover of the second golf ball being constructed of a material and having a contour substantially identical to that of the shell cover of said first golf ball, and means for attaching a tethering cord to said wall.

3. The ball of claim 2 wherein said means for attaching a tethering cord to said wall comprises a screw having a threaded shank and an eye, said shank penetrating said dome-shaped wall, said ball cover of the first ball and a portion of said core, said eye resting against said wall in force transfer relation.

4. The ball of claim 3 further defined by a convex ductile washer disposed about said shank below said wall and over said cover, said washer having a curvature matching the curvature of said cover and spanning less of the surface of the ball cover than spanned by the dome-shaped wall.

5. The ball of claim 2 further defined by an epoxy adhesive sealing layer between said dome-shaped wall and said cover.

6. A golf training device for practicing driving comprising, a regulation golf ball having a tough shell cover, a dome-shaped, force distributing wall attached to the ball, said dome-shaped wall in gripping contact with at least 5% of the surface of the ball and having a means for attaching a cable thereto, said wall being made of a material substantially identical to that of the cover of said golf ball and having a contour substantially identical to said cover, a cable anchoring means for attachment to a golf practicing surface, a three-section cable, the cable joining said cable anchoring means to said dome-shaped wall, said cable having a first length consisting of nonelastic cord connected at one end to said dome-shaped wall and connected at the opposite end to a first swivel, a second length consisting of a first elastic cord, said second length having one end connected to said first swivel and a second end connected to a second swivel, a third length consisting of a second elastic cord, said third length having one end connected to the second swivel and a second end connected to a third swivel, said third swivel connected to said cable anchoring means, said second elastic cord being substantially heavier per unit length than the first elastic cord, whereby said nonelastic cord allows initial free flight of the ball upon striking the ball and said elastic cords cause ball return, with ball spin permitted by the swivels.

7. The training device of claim 6 wherein said means for attaching a cord to said dome-shaped wall comprises an eyehook having a threaded shank penetrating the dome-shaped wall and a portion of the ball.

8. The training device of claim 6 wherein said dome-shaped wall is a circular sector of a ball cover.

* * * * *